US006899006B2

(12) United States Patent
Jolkovski

(10) Patent No.: US 6,899,006 B2
(45) Date of Patent: May 31, 2005

(54) MITER SAW MEASURING FENCE

(76) Inventor: Robert M. Jolkovski, 34 Hamilton Rd., Arlington, MA (US) 02474

( * ) Notice: Subject to any disclaimer, the term of this patent is extended or adjusted under 35 U.S.C. 154(b) by 0 days.

(21) Appl. No.: 10/654,853

(22) Filed: Sep. 4, 2003

(65) Prior Publication Data

US 2005/0051012 A1 Mar. 10, 2005

(51) Int. Cl.[7] ..... B27B 27/08; B26D 7/01
(52) U.S. Cl. ..... 83/522.18; 83/435.14
(58) Field of Search ..... 83/438, 435.14, 83/522.18

(56) References Cited

U.S. PATENT DOCUMENTS 3,941,020 A 3/1976 Huntley et al.
4,001,903 A 1/1977 Hay
4,056,030 A 11/1977 Hahn
4,122,739 A 10/1978 Marlow
4,193,331 A 3/1980 Gathings
5,327,653 A 7/1994 Pistorius et al.
6,776,076 B2 * 8/2004 Salazar ..... 83/435.14

* cited by examiner

*Primary Examiner*—Charles Goodman
(74) *Attorney, Agent, or Firm*—Barry R. Blaker

(57) ABSTRACT

A miter saw fence construction is provided by which accurate length measurement of an elongate work piece to be cut from stock material may be made. The construction includes a carrier platform slidingly and lockingly mounted to the miter saw fence. Extending rearwardly towards the fence from the front portion of the carrier platform is an elongate bar pointer whose free end is notched to receive the cut first end of stock material. Also included are measuring means having cooperative static and mobile components. The static component is secured to the fence and the mobile component is mounted to the carrier platform.

7 Claims, 3 Drawing Sheets

MITER SAW MEASURING FENCE

BACKGROUND OF THE INVENTION

Field of the Invention

The present invention relates broadly to miter saw fences and is more particularly directed to such fences whereby elongate work pieces may be miter cut to precisely measured lengths.

In general, the typical miter or chop saw table comprises a central table to which the pivot arm of the saw is rotatably mounted on a vertical axis and a fixed fence comprising coextensive lateral wings extending from each side of the central table, the rear edges of said wings having vertical rail elements and against which a work piece to be cut is maintained during the cutting operation.

Many construction projects require that elongate work pieces be miter cut to very precise lengths. One such project, for example, resides in the field of picture framing. Here, the elongate milled stock material utilized to form the frame elements are strips of wood, plastic, composite or metal molding, rabbeted on one edge. It is the rabbeted edges of the frame elements which, together, ultimately form the interior periphery of the finished frame and which thus define the dimensions of the receptacle into which the ultimate intended contents of the frame are received, such as the glass, matte, backing board, photograph, picture, or the like. Thus, in miter cutting of picture frame elements, it is the length of the inside, or rabbeted, edge of the cut work piece which constitutes the vital independent variable to be met in order to ensure proper fitting of the contents to the completed frame. While miter saw fences of the prior art are often equipped with fixed scales or other static measuring indicia engraved thereon, such indicia are difficult to read because of confusion in distinguishing between closely spaced marks, as well as parallax, and do not normally provide the requisite level of measurement precision necessary for cutting tasks requiring such precision, such as the picture framing task mentioned above. Also, movement of the elongate work piece against or along the fence during the cutting operation, such as chattering, can roughen the miter cut or introduce inaccuracies, and has also been a commonly encountered problem. In accordance with the present invention these problems have been addressed and resolved or, at the least, substantially ameliorated.

OBJECTS OF THE INVENTION

It is a principal object of the invention to provide a novel miter saw fence construction.

It is another object of the invention to provide a miter saw fence construction comprising means for precisely measuring and establishing the length of a work piece to be miter cut from elongate stock material.

It is yet another object of the invention to provide a novel miter saw fence construction comprising means for clamping the free end of elongate stock material to be miter cut against said fence, thereby mitigating against movement of the stock material during the cutting operation.

Other objects and advantages of the present invention will, in part, be obvious and will, in part appear hereinafter.

BRIEF SUMMARY OF THE INVENTION

In accordance with the invention there is provided a miter saw table comprising fixedly mounted vertical rail elements extending co-extensively to each side of a central miter saw table and together defining an elongate fence against which elongate stock material is positioned during a cutting operation. A carrier platform element extending forwardly of said fence is slidingly and lockingly mounted to one or the other of said rail elements. To the forward portion of said carrier platform element there is adjustably affixed a rearwardly angled, elongate, bar-shaped pointer element whose free end is notched to correspond to and engage the previously miter cut end of stock material to be further miter cut to its finished length. Cooperatively established between said fence and said carrier platform element is a measuring means comprising a fixed element mounted to said fence and a mobile element mounted to said carrier platform element.

THE DRAWINGS

DETAILED DESCRIPTION OF THE INVENTION

Figure 1:
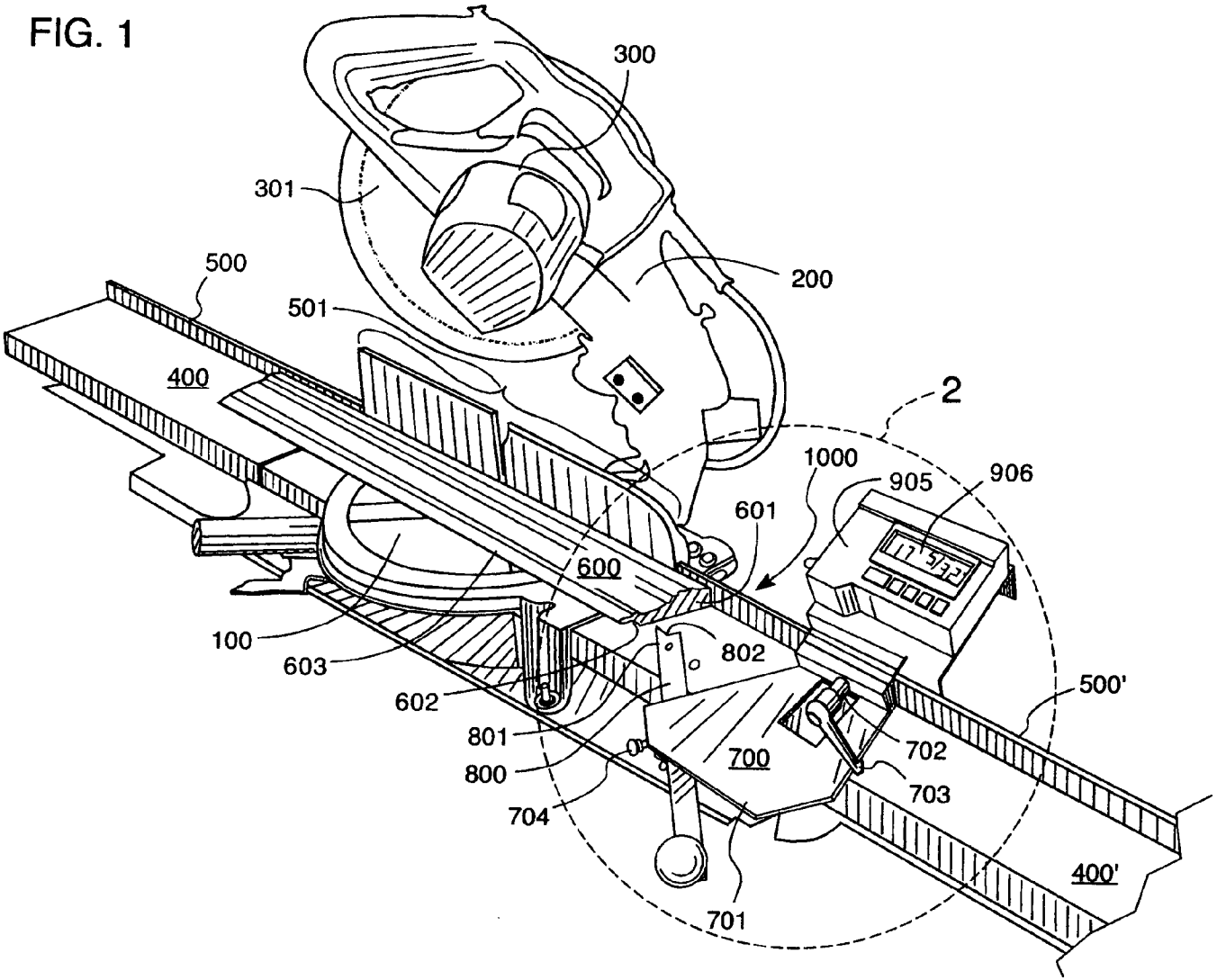
FIG. 1 is a front oblique view of a typical miter saw arrangement and comprising one embodiment of a miter saw fence construction in accordance with the invention.
Figure 2:
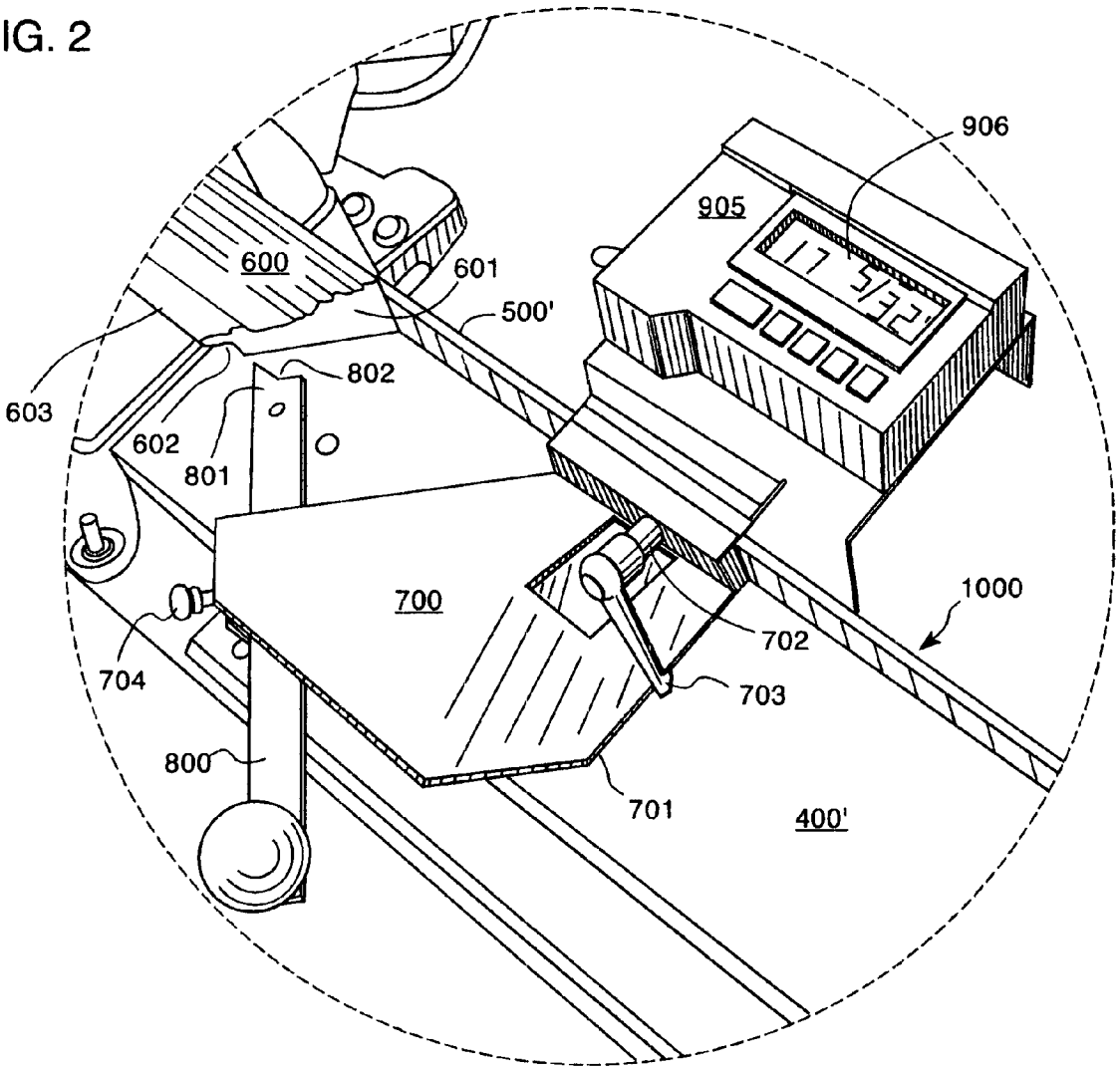
FIG. 2 is an enlarged front oblique view of that portion of the embodiment of the invention encircled in dashes in FIG. 1.
Figure 3:
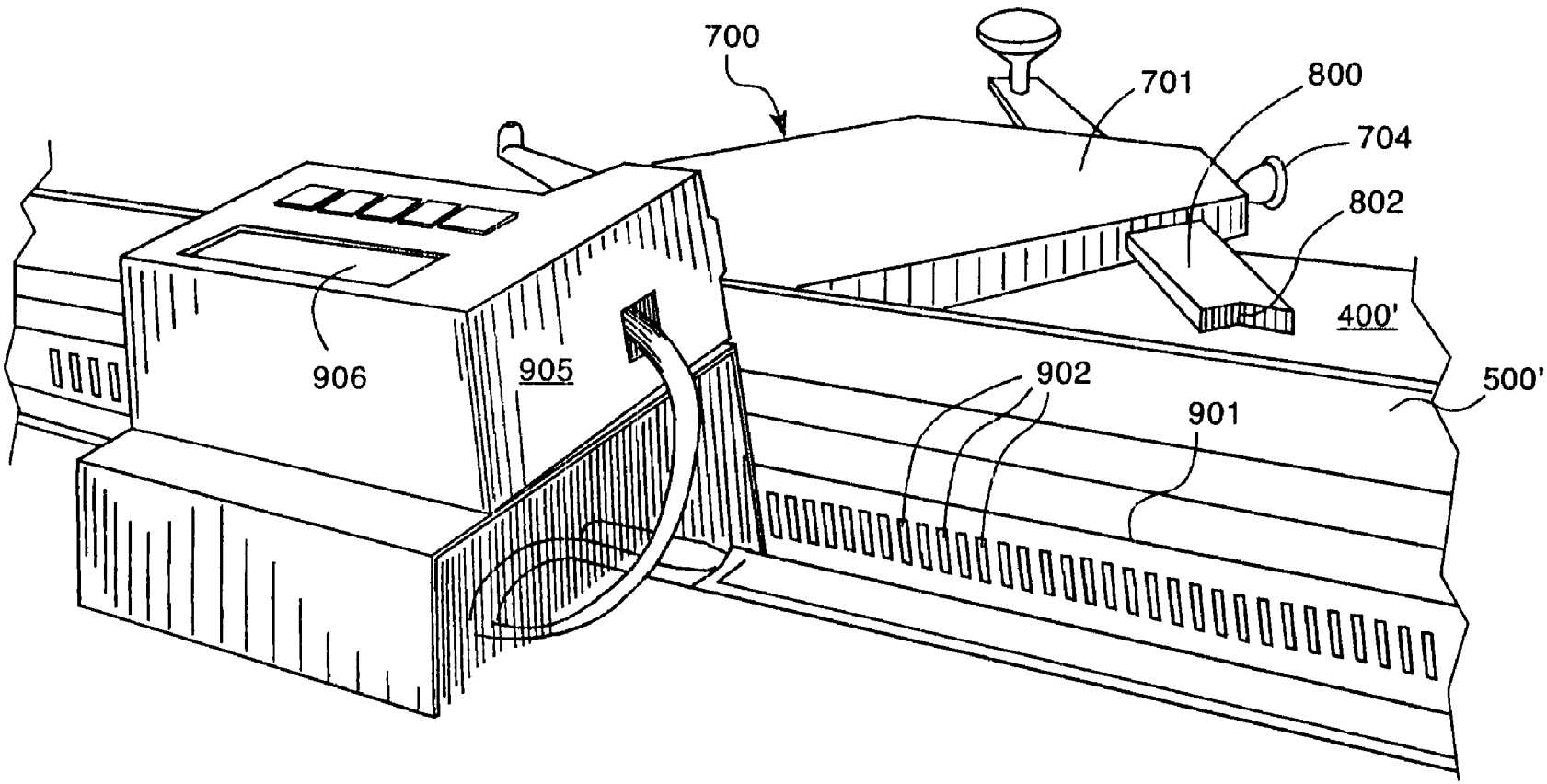
FIG. 3 is a rear oblique view of a portion of the embodiment of the invention of FIG. 1.

Referring now to FIGS. 1 through 3, wherein like reference numerals refer to like structures, the miter saw fence construction, as is known in the art, broadly comprises a central platform or table 100 to which the pivot arm 200 of a miter or chop saw 300 is rotatably mounted on a vertical axis. Extending to the left and right sides of the table 100 are lateral wings 400, 400' which define table extensions to support the stock material 600 to be cut. The rear edges of the lateral wings 400, 400' comprise co-extensive, spaced apart vertical rail elements 500, 500'. A space 501 is defined between the rail elements 500, 500' in order to allow free travel of the saw blade 301 therebetween at any of its available miter angles relative to the table 100. Thus, said vertical rail elements 500, 500' together define a fence 1000 against which the stock material 600 is held and stabilized during a cutting operation.

In accordance with the present invention there is provided a carrier platform element 700 having a portion 701 extending substantially forwardly of the fence 1000. Said carrier platform element 700 is slidingly and lockingly mountable to each of the rail elements 500, 500' of the fence 1000, The drawings hereof, of course, show said carrier platform element 700 mounted to the right-hand rail element 500'. Temporary locking of the carrier platform 700 to the rail element 500 or 500', as the case may be, can be achieved in any number of ways. For instance, such obvious expedients as cam levers, set screws and the like can be utilized to temporarily bind the carrier platform 700 to the rail element 501'. However, I generally prefer that this temporary locking function be achieved by means of a screw clamp arrangement whereby rotation of the lever 703 rotates the jackscrew 702 into engagement with the rail element 500' and thus causes the the carrier platform element 700 to be temporarily fixedly bound to the rail element 500'. Too, it is yet another alternative to provide both the sliding and locking function of the carrier platform 700 along the length of the rail element 500 or 500' by means of a rack and pinion arrangement whereby the rail element 500 or 500' is provided with teeth along its length and the carrier platform 700 is provided with a pinion adapted to cooperatively engage said teeth.

An essential element of the present invention resides in the provision of an elongate bar pointer 800 which is adjustably secured, such as by means of thumb screw 704, to the front portion 701 of the carrier platform element 700 and which bar pointer 800 is rearwardly oriented so as to define an acute angle of, say, between about 30° and about 60°, preferably about 45°, with the rail element 500 or 500' of the fence 1000, as the case may be. The free end 801 of said bar pointer 800 comprises a notch 802 which is cut at an angle at least approximately corresponding to the already miter cut free end 601 of the stock material 600. Said notch 802, as can be best seen in FIG. 2, thus securely engages said free end 601. The stock material 600 shown in the drawing is representative of typical picture frame stock and thus comprises a rabbeted notch 602 along its inner edge 603. AS will be explained in further detail hereinafter, the notch 802 of the bar pointer 800 represents the sole contact point between the stock material 600 and the measuring means of the invention. Thus, as particularly regards picture frame construction, the notch 802 of the bar pointer 800 engages the miter cut free end 601 of the stock material 600 at the rabbeted notch 602 which defines the interior periphery of the picture frame stock material. As mentioned previously, it is the interior length of picture frame stock which represents the critical independent variable dimension to be met in cutting picture frame elements of proper length to result in a finished frame which properly fits its intended contents. In order that the notch 802 of the bar pointer 800 securely engage and hold motionless the already miter cut end 601 of the stock material 600 the angle of said notch 802 should normally at least approximate the angle of the point of engagement of said notch 802 with said cut end 601. For example, where the already miter cut end of the work piece is cut at an angle of 45°, such as is commonly encountered in picture framing, the angle of the notch 802 can be about 90°. It is also contemplated that the miter saw fence of the present invention can be provided with a plurality of bar pointers 800, having differing notch 802 angles such that the proper bar pointer 800 may be readily selected for any particular cutting task.

In many mitering tasks the angle of the miter cut to be made to finish the work piece is preordained and fixed by circumstances. For example, in the field of picture framing the great preponderance of frames to be produced are rectangular in geometry. Therefore, the miter angle to be cut for the end of each frame work piece is + or −45°. Where, as in this instance, the finish miter cut angle is so preordained and preselected, it is highly desirable that the acute angle of the bar pointer 800 with respect to the rail element 500 or 500' be the same as the angle of the cut to be made by the saw blade 301. AS can be appreciated, where this condition is met there arises a parallelogram geometry wherein the parallel opposed sides are defined by the fence 1000 and the edge 603 of the stock material 600 furthest from said fence 1000 as one pair of opposed sides and the saw blade 301 and bar pointer 800 as the other pair of opposed sides. This parallelogram geometry is highly desirable in the present invention because it avoids the necessity for consideration of the width of the stock material 600 in the measurement of the finished work piece length and thus provides accurate inside length measurement of the work piece independent of its width. In the picture framing art, for instance, the width of the stock material 600 utilized can vary considerably from frame to frame.

The construction of the present invention further includes measuring means comprising a static component mounted to the fence 1000 and a mobile component mounted to carrier platform element 700. A simple example of such suitable measuring means includes a static scale component imprinted or engraved along the lengths of the rail elements 500, 500' and a cooperative mobile pointer or vernier component affixed to the platform carrier 700. Yet another simple measuring means which can be found suitable for use in the construction of the present invention takes the form of a conventional spring loaded retractable tape measure. Here, the static component is defined by the free end of the measuring tape which is affixed to the fence 1000 while the mobile component is represented by the housing for the tape containing the spring loaded take-up reel therefor. Said housing is mounted to the carrier platform 700. AS is obvious, the measuring tape in this arrangement, which may also take the form of a digital tape measure, extends and retracts in response to translation of the carrier 700 along the length of the rail element 500 or 500' to which said carrier platform is mounted. I much prefer, however, that the measuring means utilized in the miter saw fence construction of the present invention be of an electronic type in which dimensional measurement is obtained by sensing of incremental changes in an electrical condition, such as in conductance, capacitance, inductance, magnetic flux, or the like. For example, as shown in the drawings, the measuring means employed can take the form of a static signal tape 901 secured to the back of the rails 500, 500'. Said tape is imprinted with spaced apart signal generators 902. Said tape 901 is cooperatively associated with a mobile counter/reader 905 which is mounted on the carrier platform 700. Thus, translation of the carrier platform 700 along the length of the rail element 500 or 500', as the case may be, causes the counter/reader 905 to electronically scan the signal tape 901 and to convert the signals received thereby to dimensional information which is read by the operator through window 906. Such electronic measuring means are known and are commercially available. One example is a digital readout system based upon capacitance signals and which is sold under the brand name Proscale Series 950 by Mitutoyo Corporation, Tokyo, Japan.

A general mitering operation to produce a finished, two-ended work piece using the miter saw fence construction depicted in the drawings is described as follows. Firstly, one finished end of the work piece is prepared by placing the raw stock material 600 on the miter saw table and miter sawing one end thereof to the desired angle (including 0°), thereby producing the first finished end 601 of the work piece. Next, the first finished end 601 is brought into contact with the suitably conformed notch 802 of bar pointer 800, that portion of the bar pointer 800 extending rearwardly of the carrier platform 700 being adjusted so as to engage said notch 802 with the closest edge of the finished end 601. This having been accomplished the bar pointer 800 is firmly secured to the carrier platform by operation of the thumb screw 704. Carrier platform 700 is unlocked from the vertical rail element 500' by operation of the lever 703. The stock material 600 is then urged to the right along the fence 1000, the bar pointer 800 thus also forcing the sliding carrier platform 700 to the right. When the desired finished length dimension appears in the window 906 of counter/reader element 905 the carrier platform 700 is locked to the rail component 500' by retrograde motion of the lever 703. The miter saw 300 is then adjusted to the desired miter angle and the miter cut made to provide the second finished end of the stock material and a completed work piece of the desired length. The bar pointer 800 remains engaged with the stock material 600 during the cutting operation, thus clamping the free end of the stock material against the fence 1000 and mitigating against stock material movement or chatter. Too, elongate stock materials can often be slightly warped or bowed during original manufacture or storage and the continuous engagement of the bar pointer 800 with the stock material during the cutting operation also tends to beneficially straighten such warped or bowed material. Obviously, where the left-hand end of the stock material is provided with the first finished end cut, the carrier platform 700 is moved to the left-hand rail element 500, the bar pointer 800 reversed and the second end cut performed by essentially carrying out the obverse of the steps outlined above.

As previously mentioned, miter saws of commerce are generally originally supplied along with a table and fence construction. Accordingly, it is contemplated that the present invention can be provided as a kit comprising the carrier platform, bar pointer(s) and measuring means, said kit being retro-fittable to existing miter saw arrangements.

Embodiments and modifications other than the presently preferred embodiments described above may be made without departing from the scope of the invention as defined in the claims that follow.

What is claimed is:

1. A miter saw fence construction comprising:

(A) a miter saw table carrying a miter saw thereon and having spaced apart, co-extensive vertical rail elements defining a fence along the rear edge thereof;

(B) a carrier platform element slidingly and lockingly mounted to said fence, said carrier platform element having a portion extending substantially forwardly of said fence;

(C) an elongate bar pointer adjustably securable to said forward portion of said carrier platform element at an acute rearward angle with respect to said fence, said elongate bar pointer having a notched free end whose notch angle is adapted to engage the miter cut end of a work piece supported on said table; and (D) measuring means comprising a static component mounted to said fence and a mobile component cooperative with said static component, said mobile component being mounted to said carrier platform element.

2. The miter saw fence construction of claim 1 wherein said elongate bar pointer is secured to said carrier platform element at a rearward angle of about 45° with respect to said fence.

3. The miter saw fence construction of claim 1 wherein said measuring means is of an electronic type which senses a change in electrical condition.

4. The miter saw fence construction of claim 3 wherein said static component of said measuring means is a signal tape secured to said fence, said tape being imprinted with electrical condition signal generators and said mobile component mounted to said carrier platform element is a counter/reader cooperatively coupled to said tape.

5. The miter saw fence construction of claim 4 wherein said electrical condition is capacitance.

6. The miter saw fence construction of claim 1 wherein the angle of cut of said miter saw is preselected and said elongate bar pointer is secured to said carrier platform element at said preselected angle.

7. The miter saw fence construction of claim 6 wherein said preselected angle is 45°.

* * * * *